US008775085B2

(12) United States Patent
Reckmann et al.

(10) Patent No.: US 8,775,085 B2
(45) Date of Patent: Jul. 8, 2014

(54) DISTRIBUTED SENSORS FOR DYNAMICS MODELING

(75) Inventors: Hanno Reckmann, Humble, TX (US); John D. Macpherson, Spring, TX (US)

(73) Assignee: Baker Hughes Incorporated, Houston, TX (US)

( * ) Notice: Subject to any disclaimer, the term of this patent is extended or adjusted under 35 U.S.C. 154(b) by 184 days.

(21) Appl. No.: 12/372,226

(22) Filed: Feb. 17, 2009

(65) Prior Publication Data

US 2009/0216455 A1 Aug. 27, 2009

Related U.S. Application Data

(60) Provisional application No. 61/030,282, filed on Feb. 21, 2008.

(51) Int. Cl.

| | |
|---|---|
| ***G01V 11/00*** | (2006.01) |
| ***E21B 45/00*** | (2006.01) |
| ***E21B 44/00*** | (2006.01) |
| ***E21B 47/00*** | (2012.01) |
| ***G08C 19/00*** | (2006.01) |

(52) U.S. Cl.

USPC ..... 702/9; 702/33; 702/42; 702/56; 702/189; 73/152.44; 73/152.47; 73/152.48; 73/152.49; 73/152.54; 73/152.58; 73/152.59; 175/24; 175/45; 340/870.06; 340/870.11

(58) Field of Classification Search

USPC ..... 702/2, 6, 10, 11, 14, 18, 33, 42, 47, 9, 702/56, 189; 73/152.01, 152.02, 73/152.43–152.54, 152.58, 152.59; 175/24–50; 340/539.22, 853.2, 853.9, 340/855.3, 870.06, 870.11

See application file for complete search history.

(56) References Cited

U.S. PATENT DOCUMENTS

| | | | | |
|---|---|---|---|---|
| 6,026,912 | A * | 2/2000 | King et al. | 175/27 |
| 6,405,136 | B1 * | 6/2002 | Li et al. | 702/10 |
| 6,585,041 | B2 | 7/2003 | Crossley | |
| 6,722,450 | B2 * | 4/2004 | Schultz et al. | 175/39 |
| 6,997,055 | B2 | 2/2006 | DiFoggio | |

(Continued)

FOREIGN PATENT DOCUMENTS

| | | | |
|---|---|---|---|
| GB | 2358561 | A1 | 7/2001 |
| WO | WO2004007909 | | 1/2004 |
| WO | 2005086691 | A2 | 9/2005 |

OTHER PUBLICATIONS

Trindade et al., Karhunen-Loeve Decomposition of Coupled Axial/Bending Vibrations of Beams Subject to Impacts, Journal of Sound and Vibration 279 (2005) 1015-1016.*

Fay et al., Wired Pipes for High=Data-Rate MWD System, Society of Petroleum Engineers, European Conference Nov. 1992, pp. 95-104.*

J. D. Macpherson, et al. "Application and Analysis of Simultaneous Near Bit and Surface Dynamics Measurements" IADC/SPE 39397. 1998 IADC/SPE Drilling Conference held in Dallas, TX Mar. 3-6, 1998.

(Continued)

*Primary Examiner* — Sujoy Kundu
*Assistant Examiner* — L. Anderson
(74) *Attorney, Agent, or Firm* — Cantor Colburn LLP

(57) ABSTRACT

An apparatus for estimating at least one of a dynamic motion of a portion of interest of a drill string and a static parameter associated with the portion of interest, the apparatus having: a plurality of sensors operatively associated with the drill string at at least one location other than the portion of interest; and a processing system coupled to the plurality of sensors, the processing system configured to estimate at least one of the dynamic motion and the static parameter using a measurement from the plurality of sensors as input.

21 Claims, 5 Drawing Sheets

(56) References Cited

U.S. PATENT DOCUMENTS

| | | | | |
|---|---|---|---|---|
| 7,114,557 | B2 | 10/2006 | Cudmore et al. | |
| 7,142,986 | B2 * | 11/2006 | Moran | 702/9 |
| 7,172,037 | B2 * | 2/2007 | Dashevskiy et al. | 175/25 |
| 7,207,396 | B2 | 4/2007 | Hall et al. | |
| 7,555,391 | B2 * | 6/2009 | Gleitman | 702/9 |
| 7,574,325 | B2 * | 8/2009 | Dykstra | 702/186 |
| 2003/0168257 | A1 * | 9/2003 | Aldred et al. | 175/24 |
| 2003/0218940 | A1 * | 11/2003 | Jogi et al. | 367/82 |
| 2005/0194182 | A1 | 9/2005 | Rodney et al. | |
| 2005/0194185 | A1 | 9/2005 | Gleitman | |
| 2007/0272442 | A1 * | 11/2007 | Pastusek et al. | 175/40 |
| 2007/0289778 | A1 * | 12/2007 | Watkins et al. | 175/40 |

OTHER PUBLICATIONS

Pushkar N. Jogi, et al. "Field Verification of Model Derived Natural Frequencies of a Drill String". Energy Sources Technology Conference and Exhibition Copyright 1999 by ASME. ETCE 99-6648.

Examination Report for GB Patent Application No. 1014396.4, dated Jul. 11, 2012, pp. 1-3.

Canadian Office Action for CA Application No. 2,716,512, dated Jun. 6, 2012, pp. 1-4.

Examination Report for GB Patent Application No. 1014396.4, dated Nov. 26, 2012, pp. 1-3.

Canadian Office Action for CA Application No. 2,716,512, dated Mar. 7, 2013, pp. 1-3.

* cited by examiner

DISTRIBUTED SENSORS FOR DYNAMICS MODELING

CROSS REFERENCE TO RELATED APPLICATIONS

Under 35 U.S.C. §119(e), this application claims the benefit of U.S. Provisional Application No. 61/030,282, filed Feb. 21, 2008, the entire disclosure of which is incorporated herein by reference.

BACKGROUND OF THE INVENTION

1. Field of the Invention

This invention relates to drill strings. More specifically, the invention relates to apparatus and methods for estimating the dynamic behavior of the drill strings.

2. Description of the Related Art

Various types of drill strings are deployed in a borehole for exploration and production of hydrocarbons. A drill string generally includes drill pipe and a bottom hole assembly. The bottom hole assembly contains drill collars, which may be instrumented, and can be used to obtain measurements-while-drilling or while logging, for example.

While deployed in the borehole, the drill string may be subject to a variety of forces or loads. Because the drill string is in the borehole, the loads are unseen and can affect the dynamic behavior of the drill string. An immediate result of the unseen loads may be unknown. If the loads are detrimental, then continued operation of the drill string might cause damage or unreliable operation.

Testing of the drill string may be performed to simulate the loads affecting the drill string. However, the testing may not be able to simulate the same type of loads experienced in the borehole. Field testing can be conducted to determine the loads, but field testing can be prohibitively expensive or inaccurate.

Therefore, what are needed are techniques for estimating the dynamic behavior of a drill string downhole.

BRIEF SUMMARY OF THE INVENTION

Disclosed is an embodiment of an apparatus for estimating at least one of a dynamic motion of a portion of interest of a drill string and a static parameter associated with the portion of interest, the apparatus having: a plurality of sensors operatively associated with the drill string at at least one location other than the portion of interest; and a processing system coupled to the plurality of sensors, the processing system configured to estimate at least one of the dynamic motion and the static parameter using a measurement from the plurality of sensors as input.

Also disclosed is an embodiment of a system for estimating at least one of a dynamic motion of a portion of interest of a drill string and a static parameter associated with the portion of interest, the system having: a drill string disposed in a borehole; a plurality of sensors operatively associated with the drill string at at least one location other than the portion of interest; and a processing system coupled to the plurality of sensors, the processing system configured to estimate at least one of the dynamic motion and the static parameter using a measurement from the plurality of sensors as input.

Further disclosed is an example of a method for estimating at least one of a dynamic motion of a portion of interest of a drill string and a static parameter associated with the portion of interest, the method including: disposing the drill string in a borehole; receiving a measurement from at least one sensor in a plurality of sensors operatively associated with the drill string at at least one location other than the portion of interest; and estimating at least one of the dynamic motion and the static parameter using a processing system that receives the measurement as input.

BRIEF DESCRIPTION OF THE DRAWINGS

The subject matter, which is regarded as the invention, is particularly pointed out and distinctly claimed in the claims at the conclusion of the specification. The foregoing and other features and advantages of the invention are apparent from the following detailed description taken in conjunction with the accompanying drawings, wherein like elements are numbered alike, in which:

DETAILED DESCRIPTION OF THE INVENTION

Figure 1:
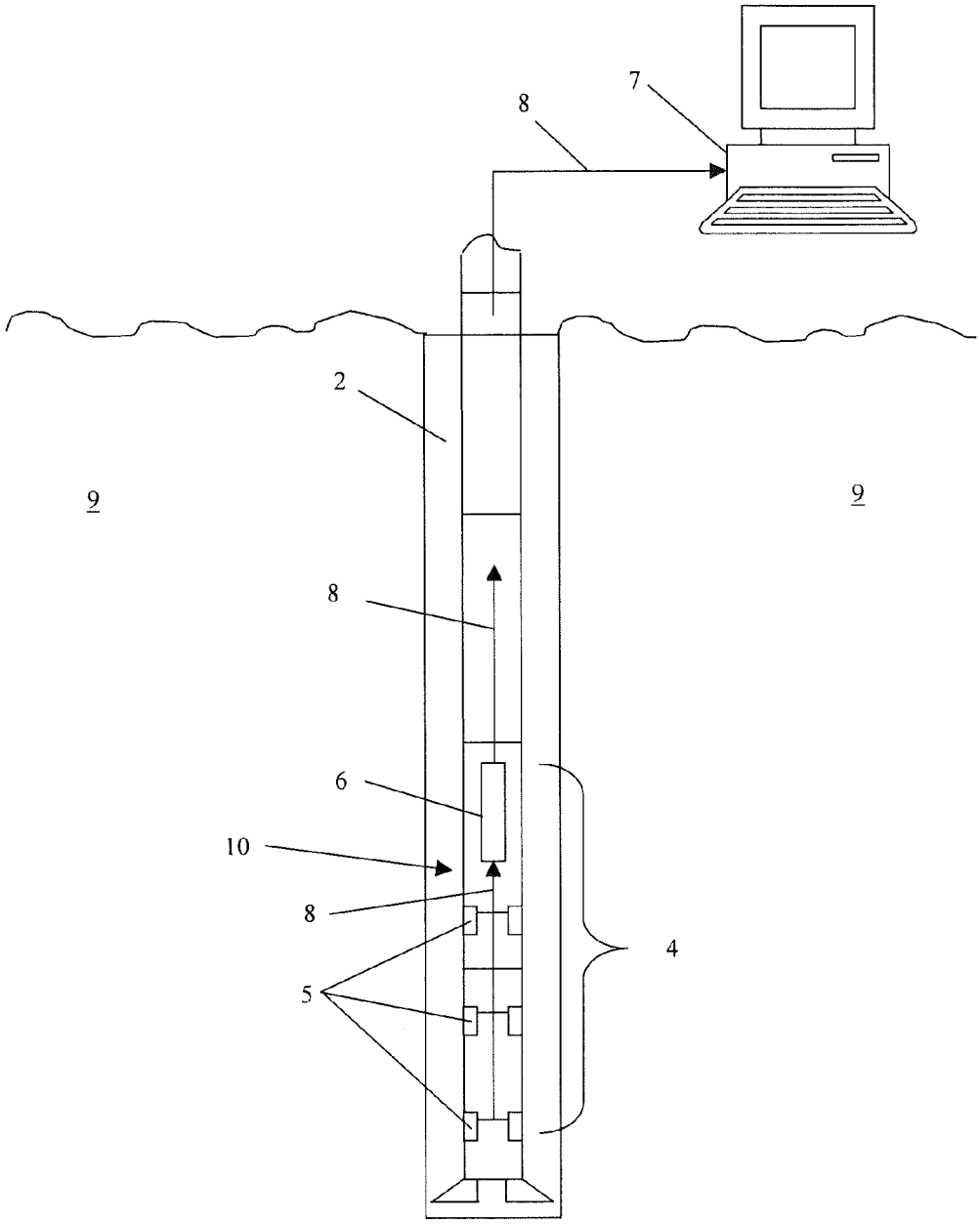
FIG. 1 is an exemplary embodiment of a drill string disposed in a borehole penetrating the earth.

Disclosed are exemplary techniques for estimating the dynamic behavior of a drill string or a static parameter associated with the drill string. The techniques, which include apparatus and methods, use a mathematical model of the tool. The mathematical model simulates the drill string experiencing forces and loads in a downhole environment. In one embodiment, solutions to the mathematical model estimate dynamic motion of the drill string at a portion of interest or the static parameter associated with the drill string at the portion of interest.

In order for the mathematical model to provide accurate solutions, the mathematical model is validated with measurements of dynamic motion or the static parameter. A dynamic motion or static parameter is estimated for a location at which a measurement is performed. The dynamic motion or static parameter is then compared to the measurement. If the difference between the estimated dynamic motion or the static parameter and the measurement is within a certain tolerance, then the mathematical model is validated. When the mathematical model is validated, then estimates of dynamic motion or static parameters for portions of the drill string, which are not measured, are considered valid. Loads such as forces or moments imposed on the drill string in the mathematical model can also be validated this way. The measurements are generally updated on a continuous basis while the drill string is operating. Sensors distributed at the drill string (i.e., operatively associated with the drill string) are used to provide the measurements of dynamic motion or the static parameter.

For convenience, certain definitions are presented for use throughout the specification. The term "drill string" relates to at least one of drill pipe and a bottom hole assembly. In general, the drill string includes a combination of the drill pipe and the bottom hole assembly. The bottom hole assembly may be a drill bit, sampling apparatus, logging apparatus, or other apparatus for performing other functions downhole. As one example, the bottom hole assembly can be a drill collar containing measurement while drilling (MWD) apparatus. The term "dynamic motion" relates to a change in steady-state motion of the drill string. Dynamic motion can include vibrations and resonances. The term "static parameter" relates to a parameter associated with a drill string. The static parameter is generally a physical condition experienced by the drill string. Non-limiting examples of the static parameter include a displacement, a force or load, a moment, or a pressure. The static parameter is generally unchanging but to the extent that this parameter may change an average of the parameter may be calculated or estimated.

The term "distributed sensor system" relates to a plurality of sensors distributed at the drill string or operatively associated with the drill string. The distributed sensor system measures dynamic parameters associated with the drill string. Non-limiting example of measurements performed by the sensors include accelerations, velocities, distances, angles, forces, moments, and pressures. As these sensors are known in the art, they are not discussed in any detail herein. As one example of distribution of sensors, the sensors may be distributed throughout a drill string and tool (such as a drill bit) at the distal end of the drill string. In addition, the sensors may be distributed on a section of the drill string not disposed in the borehole. The term "observable" relates to performing one or more measurements of parameters associated with the dynamic motion of the drill string including static parameters wherein the measurements enable a mathematical model or an algorithm to estimate other parameters of the drill string that are not measured.

Referring to FIG. 1, an exemplary example of a drill string 10 is shown disposed in a borehole 2 penetrating the earth 9. A distributed sensor system (DSS) 4 is shown disposed on the drill string 10. In the embodiment of FIG. 1, the DSS 4 includes a plurality of sensors 5. The sensors 5 perform measurements associated with the dynamic motion of the drill string 10 or a static parameter associated with the drill string 10. The sensors 5 are generally coupled to a downhole electronics unit 6. The downhole electronics unit 6 receives data 8 (i.e., the measurements) from the sensors 5 and transmits the data 8 to a processing system 7. In some embodiments, the downhole electronics unit 6 can multiplex the data 8 for transmission to the processing system 7. The processing system 7 may be disposed at least one of at the surface of the earth 9 as shown in FIG. 1 and in the borehole 2 such as at a bottom hole assembly. Further, the processing system 7 may provide distributed processing by being distributed with the sensors 5 or along the drill string 10. Various techniques may be used to transmit the data 8 to the processing system 7 such as mud pulse, electromagnetic, acoustic telemetry, or "wired pipe."

In one embodiment of wired pipe, the drill string 10 (or drill pipe 10) is modified to include a broadband cable protected by a reinforced steel casing. At the end of each drill pipe, there is an inductive coil, which contributes to communication between two drill pipes. In this embodiment, the broadband cable is used to transmit the data 8 to the processing system 7. About every 500 meters, a signal amplifier is disposed in operable communication with the broadband cable to amplify the data to account for signal loss. The processing system 7 receives the data 8 from the drill pipe 10 at the surface of the earth 9 in the vicinity of the borehole 2 or other desired remote location.

One example of wired pipe is INTELLIPIPE™ commercially available from Intellipipe of Provo, Utah. Intellipipe has data transfer rates from 57 thousand bits per second to one million bits per second.

Wired pipe is one example of high speed data transfer. The high speed data transfer enables sampling rates of the dynamic parameters at up to 200 Hz or higher with each sample being transmitted to the surface of the earth 9. Because of the high speed data transfer, many sensors 5 can be used to measure the dynamic parameters helping to insure an accurate solution to the mathematical model of the drill string 10.

Various configurations of the distributed sensor system 4 may be used. For example, the embodiment of FIG. 1 includes the plurality of sensors 5, however, in other embodiments one sensor 5 may be used. As another example, the embodiment of FIG. 1 includes the downhole electronics unit 6, however, in other embodiments the downhole electronics unit 6 may not be used wherein the sensors 5 may transmit the data 8 directly to the processing system 7.

Turning now to the processing system 7, the processing system 7 may include a computer processing system. Exemplary components of the computer processing system include, without limitation, at least one processor, storage, memory, input devices, output devices and the like. As these components are known to those skilled in the art, these are not depicted in any detail herein.

Generally, some of the teachings herein are reduced to an algorithm that is stored on machine-readable media. The algorithm is implemented by the computer processing system and provides operators with desired output.

Figure 2:
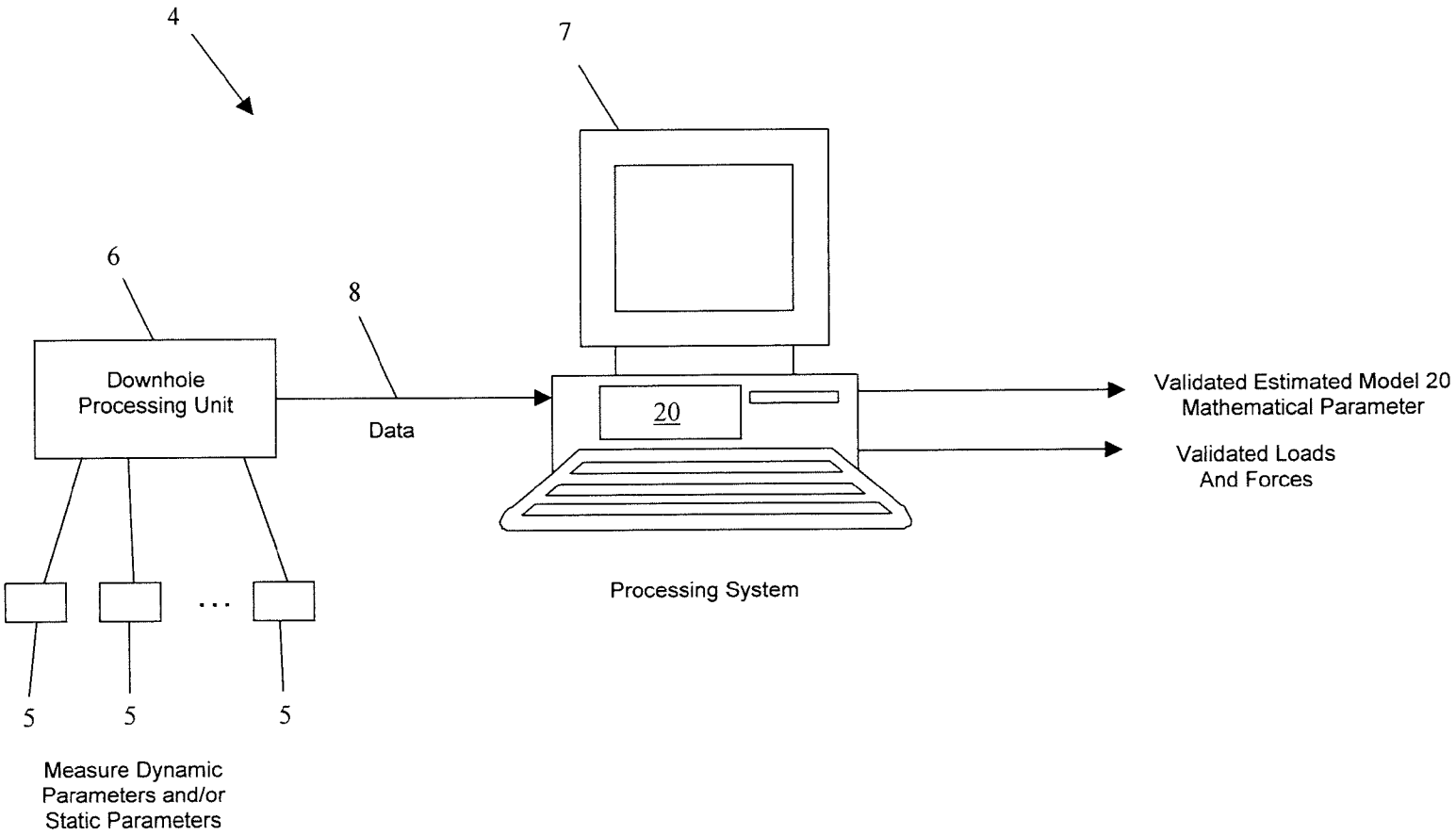
FIG. 2 depicts aspects of using a distributed sensor system for validating the accuracy of a mathematical model that estimates the behavior of the drill string.

The distributed sensor system 4 may be used in several applications. FIG. 2 depicts aspects of using the distributed sensor system 4 for validating the accuracy of a mathematical model 20 (or algorithm 20) that estimates a dynamic motion of the drill string 10 or a static parameter associated with the drill string 10. A solution to the mathematical model 20 may be obtained, for example, in at least one of the time domain and the frequency domain. Referring to FIG. 2, the data 8 is received by the processing system 7. The processing system 7 estimates the dynamic motion or the static parameter using the mathematical model 20. The estimated dynamic motion or the estimated static parameter is for a location for which one sensor 5 is associated. The processing system 7 compares the estimated dynamic motion to a measured dynamic motion obtained from the DSS 4. If the estimated dynamic motion differs from the measured dynamic motion by less than a certain amount, then the mathematical model 20 is noted as being validated. Similarly, the mathematical model 20 can be validated for estimates of the static parameter. The mathematical model 20 that is validated provides assurance that estimates of dynamic motion or the static parameter for other locations, which are not associated with sensors 5, are accurate. In some embodiments, comparisons of estimated dynamic motions and estimated static parameters to measured parameters may be performed at or above the sampling rate. High sampling and comparison rates can increase the accuracy of validation.

The validated mathematical model 20 also provides validated estimates of loads and forces imposed upon the drill string 10. Using accurate estimated loads and forces provides for accurate estimates of the dynamic motions at a portion of interest of the drill string 10 and the static parameter associated with the portion of interest.

Figure 3:
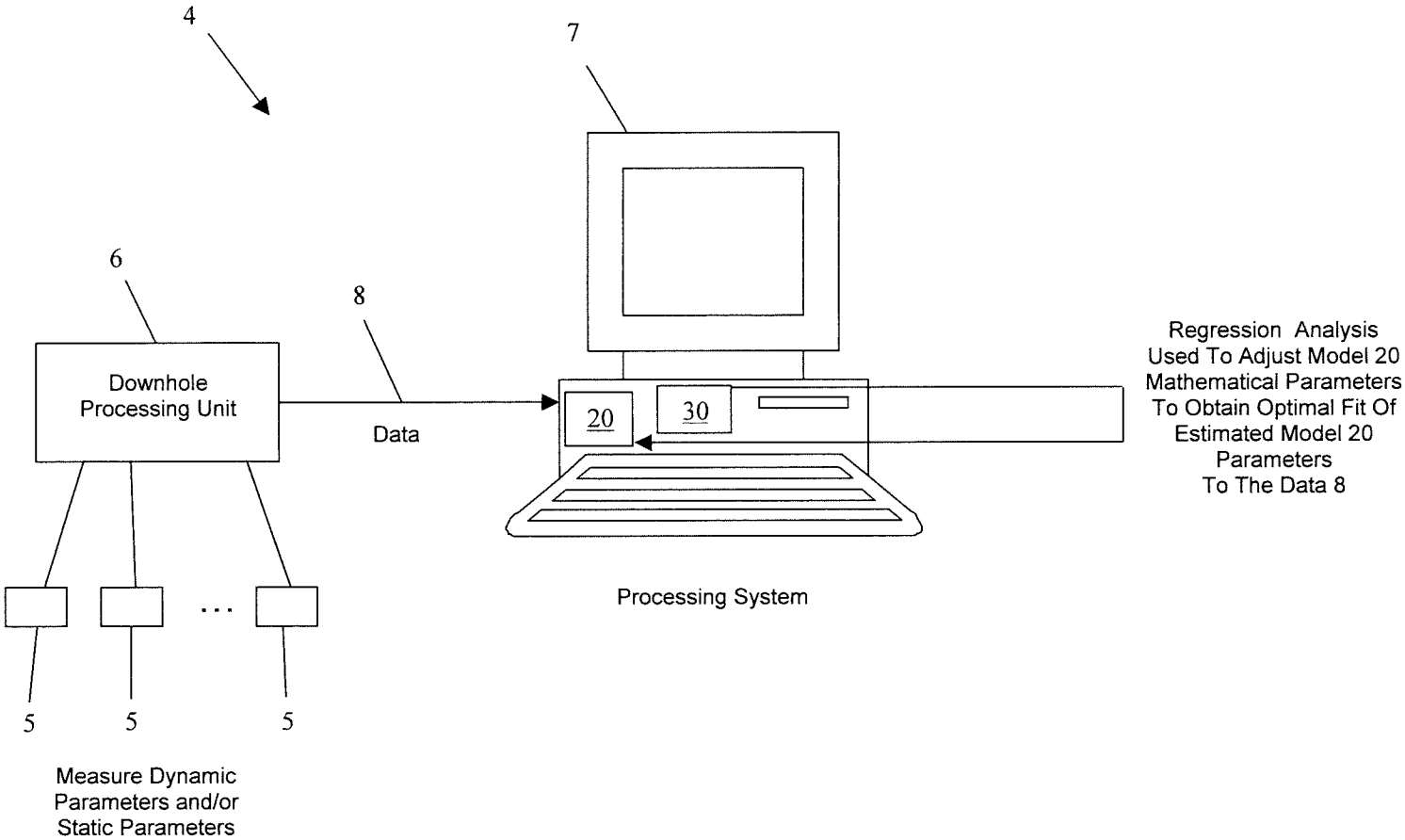
FIG. 3 depicts aspects of determining mathematical parameters for the mathematical model.

In another application, the data 8 obtained from the distributed sensor system 4 may be used to create mathematical parameters used in the mathematical model 20. FIG. 3 depicts aspects of determining or adjusting the mathematical parameters. The mathematical model 20 uses equations to model the behavior of the drill string 10. The equations generally include mathematical parameters that can be determined or adjusted from the data 8 using regression analysis such as least squares for example. Regression analysis is used to model numerical data obtained from observations (such as the data 8) by adjusting the mathematical parameters to get an optimal fit of the data 8. With least squares, the optimal fit corresponds to the mathematical parameters that provide the least value of the sum of the squares of the differences between the observed values and the predicted values.

Referring to FIG. 3, a regression analysis algorithm 30 compares the numerical data predicted by the mathematical model 20 with the observed numerical data provided by the data 8. The regression analysis algorithm 30 adjusts the mathematical parameters of the model 20 to provide the least squares value. In general, the greater the number of sensors 5 at different locations on the drill string 10, the greater will be the accuracy of the mathematical parameters used in the mathematical model 20. The model 20 developed this way can have sufficient accuracy for estimating damping or resonant frequencies of the drill string 10.

Figure 4:
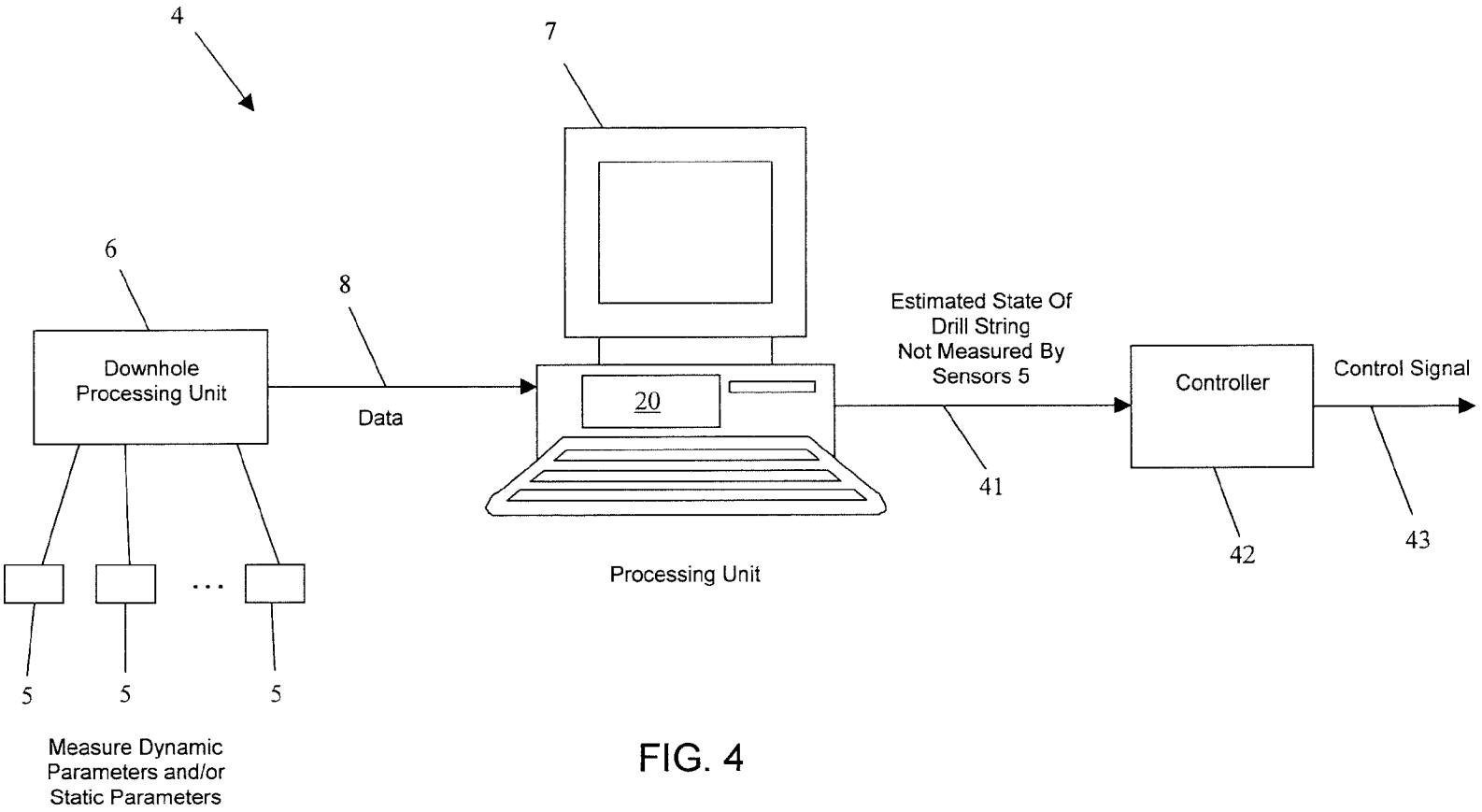
FIG. 4 depicts aspects of estimating states of the drill string using an observer algorithm.

In yet another application, the data 8 obtained from the distributed sensor system 4 may be used with the mathematical model 20 to estimate states of the drill string 10 that are not measured. An example of a state not measured is a position of the drill string 10 not measured by the distributed sensor system 4. The states can represent any variable that is not measured by the distributed sensor system 4. In applications to estimate states of the drill string 10, the mathematical model 20 may be referred to as an "observer" (observer 20) in the art of controls engineering. The observer 20 is an algorithm that models the behavior of the drill string 10 in order to provide an estimate of an internal state given measurements (such as the data 8) of the input to and the output from the drill string 10. It is important to place the sensors 5 in locations that make the behavior of the drill string 10 observable. Generally, increasing the number of measurements input into the observer 20 results in more accurate estimation of the states. FIG. 4 depicts aspects of estimating states with the observer 20.

Examples of the observer 20 include the "Luenberger Observer" and the "Kalman Filter," which are generally used for linear systems. For nonlinear systems, the "Extended Kalman filter" or parametric models such as "neural networks" may be used. The Extended Kalman filter converts all nonlinear models to linear models so that the traditional Kalman filter can be applied. Neural networks generally need to be "trained" over a period of time. The training process generally incorporates using the data 8.

Besides using the estimated states to supervise operation of the drill string 10, the estimated states may also be used as input to a controller controlling the operation of the drill string 10. FIG. 4 also depicts aspects of using the estimated states for controlling the drill string 10. Referring to FIG. 4, the observer 20 receives the data 8 from the distributed sensor system 4 and provides an estimated state 41. A controller 42 receives the estimated state 41 and provides a control signal 43. Next, the control signal 43 is input to a system that controls operation of the drill string 10. As one example, the control signal 43 may be used to minimize vibration amplitudes of the drill string 10.

For control purposes, it is essential to have the observer 20 perform fast calculations of the estimated states. Fast calculations may be performed by the observer 20 by reducing the complexity of the algorithm used in the observer 20. The complexity can be reduced using a modal transformation or a "Karhunen Loeve" decomposition. With these complexity reduction methods (to produce low order algorithms), only significant modes in a modal analysis are considered for use in the observer 20. With measurements at several locations on the drill string 10, the drill string 10 is observable and the significant modes are readily determined.

The observer 20 with a low order algorithm can be run in "real time" to provide real time control. As used herein, generation of the data 8 in "real-time" is taken to mean generation of the data 8 at a rate that is useful or adequate for providing control functions or making decisions during or concurrent with processes such as production, experimentation, verification, and other types of surveys or uses as may be opted for by a user or operator. Accordingly, it should be recognized that "real-time" is to be taken in context, and does not necessarily indicate the instantaneous determination of the data 8, or make any other suggestions about the temporal frequency of data collection and determination.

A high degree of quality control over the data 8 may be realized during implementation of the teachings herein. For example, quality control may be achieved through known techniques of iterative processing and data comparison. Accordingly, it is contemplated that additional correction factors and other aspects for real-time processing may be used. Advantageously, the user may apply a desired quality control tolerance to the data 8, and thus draw a balance between rapidity of determination of the data 8 and a degree of quality in the data 8.

There may be limited goals for controlling the drill string 10. Therefore, a density of placement of the sensors 5 on the drill string 10 may be varied according the goals. For example, the sensors 5 can be placed mostly on a region of the drill string 10 if controlling a portion of interest in or near the region is the goal, such as controlling a downhole tool. Alternatively, the sensors 5 can be placed along the drill string 10 if, for instance, controlling vibration of the drill string 10 is the goal.

One benefit from using the distributed sensor system 4 with a high speed data transfer system such as the wired pipe for example is that each data component of the data 8 can be time stamped. In addition, the small latency or near zero time delay associated with the high speed data transfer system is essential for most control approaches.

The functions of the algorithm 20 depicted in FIGS. 2, 3, and 4 may be integrated into one algorithm 20. An operator or the algorithm 20 may select which functions or combination of functions the algorithm 20 will apply to the data 8.

Figure 5:
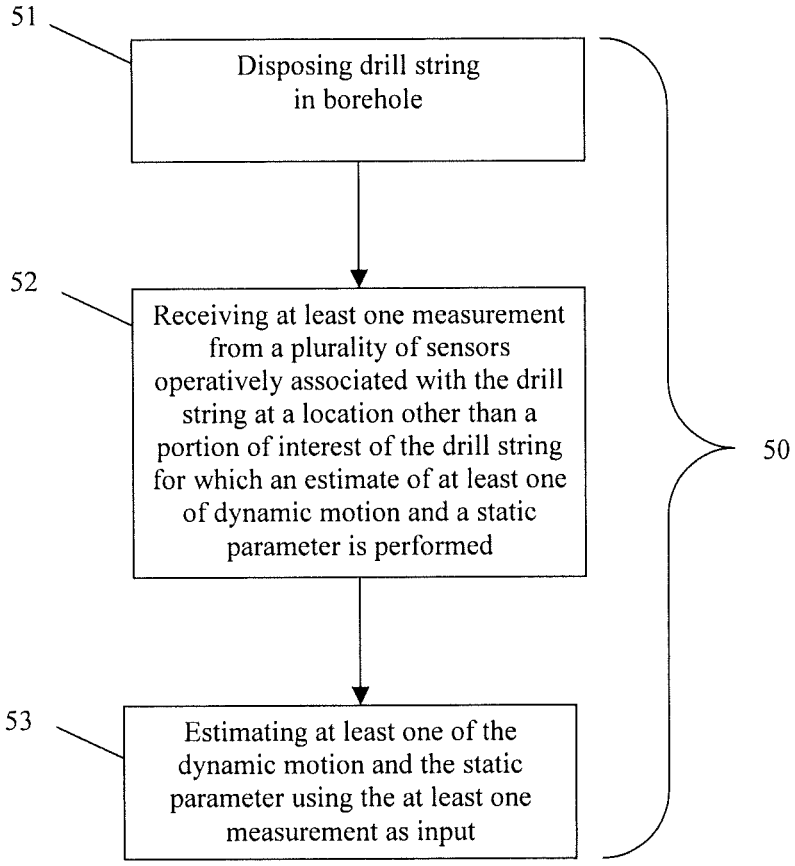
FIG. 5 presents an example of a method for estimating a parameter of the drill string.

FIG. 5 presents one example of a method 50 for estimating at least one of a dynamic motion of a portion of interest of the drill string 10 and a static parameter associated with the portion of interest. The method 50 calls for (step 51) disposing the drill string 10 in the borehole 2. Further, the method 50 calls for (step 52) receiving at least one measurement from the plurality of sensors 5 operatively associated with the drill string 10 at a location other than the portion of interest. Further, the method 50 calls for (step 53) estimating at least one of the dynamic motion and the static parameter using the processing system 7 that uses the measurement as input. The processing system in step 53 can use the at least one measurement to validate the algorithm 20 or mathematical model 20 used by the processing system 7 and, therefore, validate the estimated dynamic motion and/or the estimated static parameter. When the estimated dynamic motion and/or the static parameter are validated, the loads and forces used to perform the estimate are also validated. Alternatively, the algorithm 20 or mathematical model 20 can include an observer algorithm that estimates a state of the drill string 10 at the portion of interest when there is no sensor 5 to measure or validate the state at the portion of interest.

In support of the teachings herein, various analysis components may be used, including digital and/or analog systems. The digital and/or analog systems may be included in the downhole electronics unit 6 or the processing system 7 for example. The system may have components such as a processor, analog to digital converter, digital to analog converter, storage media, memory, input, output, communications link (wired, wireless, pulsed mud, optical or other), user interfaces, software programs, signal processors (digital or analog) and other such components (such as resistors, capacitors, inductors and others) to provide for operation and analyses of the apparatus and methods disclosed herein in any of several manners well-appreciated in the art. It is considered that these teachings may be, but need not be, implemented in conjunction with a set of computer executable instructions stored on a computer readable medium, including memory (ROMs, RAMs), optical (CD-ROMs), or magnetic (disks, hard drives), or any other type that when executed causes a computer to implement the method of the present invention. These instructions may provide for equipment operation, control, data collection and analysis and other functions deemed relevant by a system designer, owner, user or other such personnel, in addition to the functions described in this disclosure.

Further, various other components may be included and called upon for providing for aspects of the teachings herein. For example, a power supply (e.g., at least one of a generator, a remote supply and a battery), cooling component, heating component, motive force (such as a translational force, propulsional force, or a rotational force), digital signal processor, analog signal processor, sensor, magnet, antenna, transmitter, receiver, transceiver, controller, optical unit, electrical unit or electromechanical unit may be included in support of the various aspects discussed herein or in support of other functions beyond this disclosure.

Elements of the embodiments have been introduced with either the articles "a" or "an." The articles are intended to mean that there are one or more of the elements. The terms "including" and "having" and their derivatives are intended to be inclusive such that there may be additional elements other than the elements listed. The term "or" when used with a list of at least two items is intended to mean any item or combination of items.

It will be recognized that the various components or technologies may provide certain necessary or beneficial functionality or features. Accordingly, these functions and features as may be needed in support of the appended claims and variations thereof, are recognized as being inherently included as a part of the teachings herein and a part of the invention disclosed.

While the invention has been described with reference to exemplary embodiments, it will be understood that various changes may be made and equivalents may be substituted for elements thereof without departing from the scope of the invention. In addition, many modifications will be appreciated to adapt a particular instrument, situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An apparatus for estimating a dynamic motion of a portion of interest of a drill string, the apparatus comprising:

a plurality of sensors operatively associated with the drill string at at least one location other than the portion of interest; and a processing system coupled to the plurality of sensors, the processing system configured to validate an algorithm based on a comparison of an estimate of the dynamic motion at the at least one location other than the portion of interest, obtained based on inputting a measurement from the plurality of sensors to the algorithm, to a measurement of the dynamic motion at the at least one location other than the portion of interest and to estimate the dynamic motion of the portion of interest using the measurement from the plurality of sensors as a direct input to the algorithm providing the estimate when the algorithm is validated.

2. The apparatus as in claim 1, further comprising estimating a static parameter associated with the portion of interest, wherein the static parameter is selected from a group consisting of a force, a load, a moment, an average force, an average load, and an average torque.

3. The apparatus as in claim 1, wherein a rate of validation is at least a sampling rate for data obtained from the plurality of sensors.

4. The apparatus as in claim 1, wherein the processing system uses another algorithm for determining a mathematical parameter of the algorithm used by the processing system.

5. The apparatus as in claim 4, wherein the another algorithm comprises a method of least squares with respect to a difference between the measurement of the dynamic motion and the estimate of the dynamic motion at the at least one location other than the portion of interest to determine the mathematical parameter.

6. The apparatus as in claim 1, wherein the algorithm comprises an observer algorithm to estimate the dynamic motion.

7. The apparatus as in claim 6, wherein the observer algorithm comprises at least one selection from a group consisting of a Luenberger Observer, a Kalman filter, an Extended Kalman filter, and a parametric model.

8. The apparatus as in claim 7, wherein when the observer algorithm comprises the parametric model, the parametric model comprises a neural network.

9. The apparatus as in claim 1, wherein the algorithm is reduced by at least one of reducing a modal transformation to at least one significant mode and using a Karhunen Loeve decomposition.

10. The apparatus as in claim 1, further comprising a controller coupled to the processing system wherein the controller is configured to receive the dynamic motion of the portion of interest to control the drill string.

11. The apparatus as in claim 1, wherein at least one sensor in the plurality of sensors measures at least one selection from a group consisting of acceleration, velocity, distance, and angle.

12. The apparatus as in claim 1, wherein the processing system is disposed at a location selected from a group consisting of the surface of the earth and at the drill string.

13. A system for estimating a dynamic motion of a portion of interest of a drill string, the system comprising:

a drill string disposed in a borehole;

a plurality of sensors operatively associated with the drill string at at least one location other than the portion of interest; and a processing system coupled to the plurality of sensors, the processing system configured to validate an algorithm based on a comparison of an estimate of the dynamic motion at the at least one location other than the portion of interest, obtained based on inputting a measurement from the plurality of sensors to the algorithm, to a measurement of the dynamic motion at the at least one location other than the portion of interest and to estimate the dynamic motion of the portion of interest using the measurement from the plurality of sensors as a direct input to the algorithm providing the estimate when the algorithm is validated.

14. The system as in claim 13, further comprising a controller coupled to the processing system, the controller configured to receive a signal from the processing system for controlling the drill string.

15. The system as in claim 13, further comprising a data transfer system configured to transmit data between the plurality of sensors and to the processing system.

16. The system as in claim 15, wherein the data transfer system comprises a wired pipe.

17. The system as in claim 16, wherein the processing system receives measurements from the at least one sensor at a sampling rate of at least 200 Hertz.

18. A method for estimating a dynamic motion of a portion of interest of a drill string, the method comprising:

disposing the drill string in a borehole;

receiving a measurement from at least one sensor in a plurality of sensors operatively associated with the drill string at at least one location other than the portion of interest;

validating a mathematical model used by a processing system by comparing an estimate of the dynamic motion at the at least one location other than the portion of interest, obtained based on inputting the measurement from the at least one sensor to the mathematical model, to a measurement of the dynamic motion at the at least one location other than the portion of interest; and when the mathematical model is validated, estimating the dynamic motion of the portion of interest using the processing system that receives the measurement as a direct input to the mathematical model providing the estimate.

19. The method as in claim 18, further comprising transmitting the dynamic motion to a controller configured to control the drill string.

20. The method as in claim 18, further comprising using the measurement to adjust a parameter used in the mathematical model that estimates the dynamic motion.

21. The method as in claim 18, wherein the receiving and the estimating are implemented by a computer program product comprising machine readable instructions stored on non-transitory machine readable media.

* * * * *